US005465692A

United States Patent [19]

Uraki et al.

[11] Patent Number: 5,465,692

[45] Date of Patent: Nov. 14, 1995

[54] CONSTRUCTION OF OIL PAN FOR INTERNAL COMBUSION ENGINE

[75] Inventors: Yoichi Uraki, Yokohama; Takao Kubozuka, Yokosuka; Masahiko Kondo, Yokohama; Hiroshi Miyakubo; Hisafumi Usuki, both of Yokosuka, all of Japan

[73] Assignee: Nissan Motor Co., Ltd., Yokohama, Japan

[21] Appl. No.: 267,014

[22] Filed: Jun. 21, 1994

[30] Foreign Application Priority Data

Jun. 30, 1993 [JP] Japan ..... 5-161144

[51] Int. Cl.[6] ..... F02F 7/00

[52] U.S. Cl. ..... 123/195 C; 123/195 H; 184/106

[58] Field of Search ..... 123/196 R, 195 C, 123/195 H; 184/106, 6.5; 220/573

[56] References Cited

U.S. PATENT DOCUMENTS 4,911,118 3/1990 Kageyama et al. ..... 123/195 C 4,938,184 7/1990 Martin et al. ..... 123/195 C 5,038,890 8/1991 Tanaka et al. ..... 184/106

5,103,782 4/1992 Matsui ..... 123/195 C

*Primary Examiner*—Henry C. Yuen

*Assistant Examiner*—Erick Solis

*Attorney, Agent, or Firm*—Foley & Lardner

[57] ABSTRACT

An oil pan for an internal combustion engine includes an outer shell made of metal plate an includes on at least a bottom surface of the outer shell and inner pan separate from the outer shell. The bottom of the oil pan includes a deep portion and a shallow portion and a baffle plate is disposed over the inner pan. The inner pan settles on the inner surface of the outer shell amidst the oil contained in the oil pan, thereby forming a layer of oil between the outer shell and the inner pan. Thus, oil flow is not impeded and vibration of the oil pan is significantly reduced. In addition, wall portions of the inner pan are made to be deformable so as not to cause strong impact to other portions of the oil pan structure or to engine components.

18 Claims, 8 Drawing Sheets

CONSTRUCTION OF OIL PAN FOR INTERNAL COMBUSION ENGINE

BACKGROUND OF THE INVENTION

1. Field of the Invention

The present invention relates generally to an oil pan for an internal combustion engine. Specifically, the present invention relates to an oil pan which is easily manufactured and which exhibits low noise emmission characteristics.

2. Description of the Prior Art

Various designs have been proposed for oil pans of internal combustion engines. Generally, the oil pan is positioned at a lower side of a cylinder block of an internal combustion engine and is of a comparatively deep relief for receiving accumulated lubricating oil from the engine block which is pumped throughout the engine under pressure by an oil pump. Such oil pans are generally made by pressing of a thin metal plate. Consequently, when engine vibration is applied thereto a relatively loud noise may be caused by the vibration of the oil pan.

To address this problem, Japanese Utility Model application 54-25941 disclose an oil pan for an internal combustion engine having a two-ply construction. The disclosed oil pan includes an outer layer and an inner layer with a given gap therebetween, the inner layer being formed with a plurality of holes therethrough. Lubricating oil is allowed to flow between the inner and outer layers and the holes provided in the inner layer are effective to reduce vibration applied to the oil pan.

However, according to the above construction, since the inner layer must be formed with the plurality of holes and must be fixedly supported by the outer layer, manufacturing of the oil pan becomes complex and costs are raised significantly due to the number of parts and required processing. Further, since the oil flows between the outer and inner layer through the plurality of holes of the inner layer, oil flow caused by oil pan vibration is impeded and energy loss may be incurred. Also, the limits in constructing the oil pan limits the gap between the inner and outer layers, etc., and it is thus difficult to obtain sufficient noise reduction.

Thus it has been required to provide an oil pan for an internal combustion engine in which sufficient vibration reduction and noise emmission reduction can be obtained with simple, low cost construction.

SUMMARY OF THE INVENTION

It is therefore a principal object of the present invention to overcome the drawbacks of the prior art.

It is a further object of the present invention to provide an oil pan for an internal combustion engine in which sufficient vibration reduction and noise emmission reduction can be obtained with simple, low cost construction.

In order to accomplish the aforementioned and other objects, an oil pan for an internal combustion engine is provided, comprising an outer pan attached to a lower side of the engine block, and an inner pan disposed within the outer pan so as to float freely in a fluid contained in the outer pan.

DESCRIPTION OF THE PREFERRED EMBODIMENT

Figure 1:
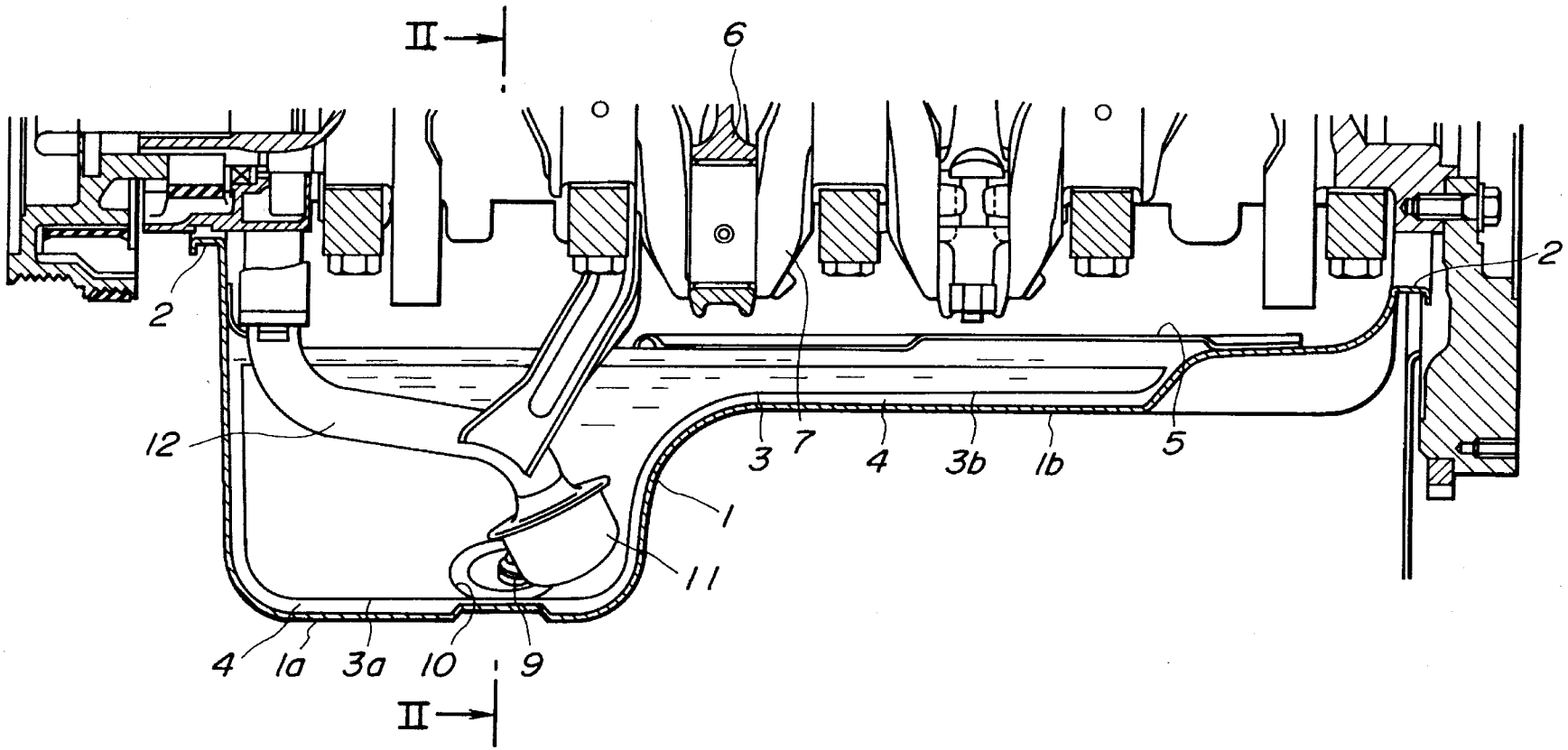
FIG. 1 shows a cross-sectional view of a first embodiment of an oil pan according to the invention.
Figure 2:
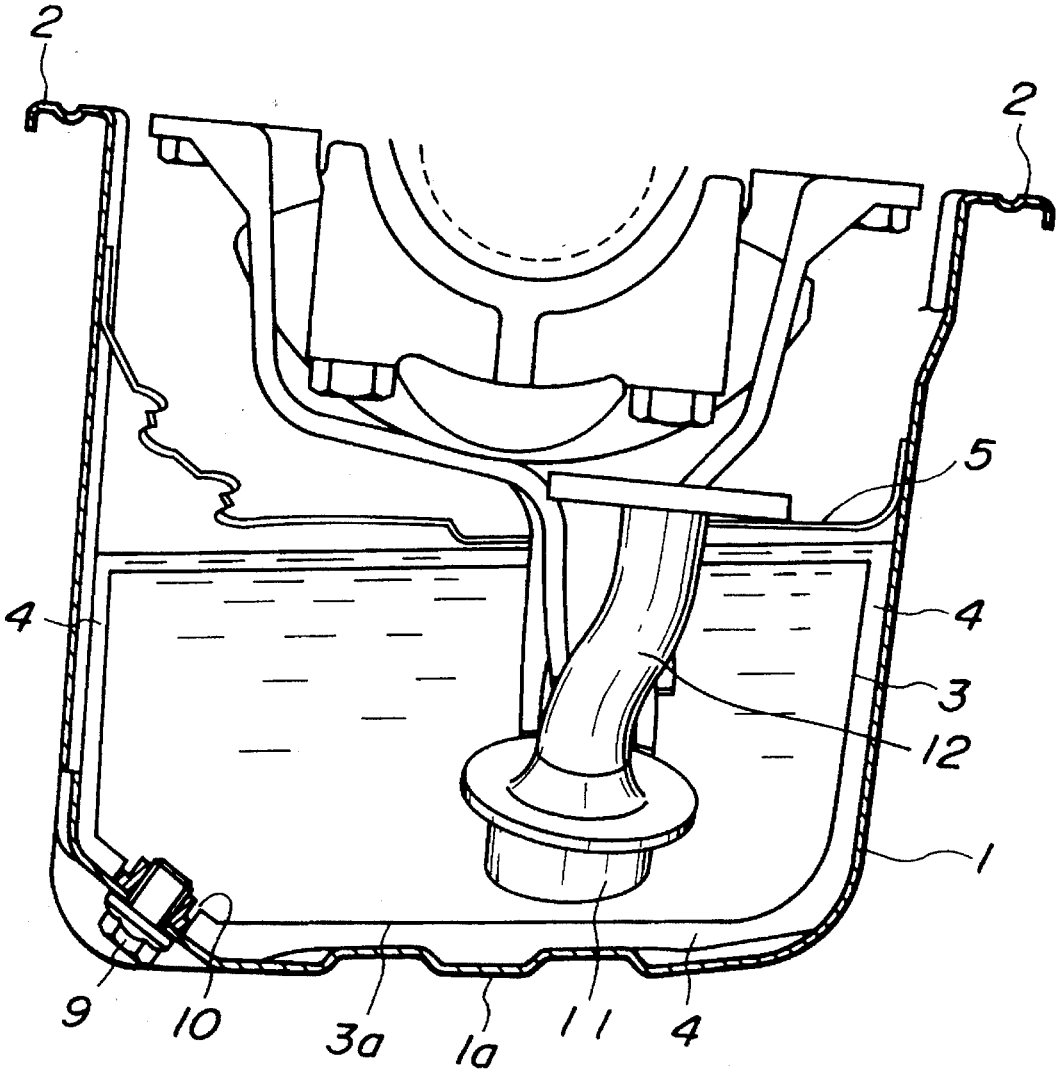
FIG. 2 is a lateral view of the oil pan of the first embodiment, taken along line II—II of FIG. 1.
Figure 3:
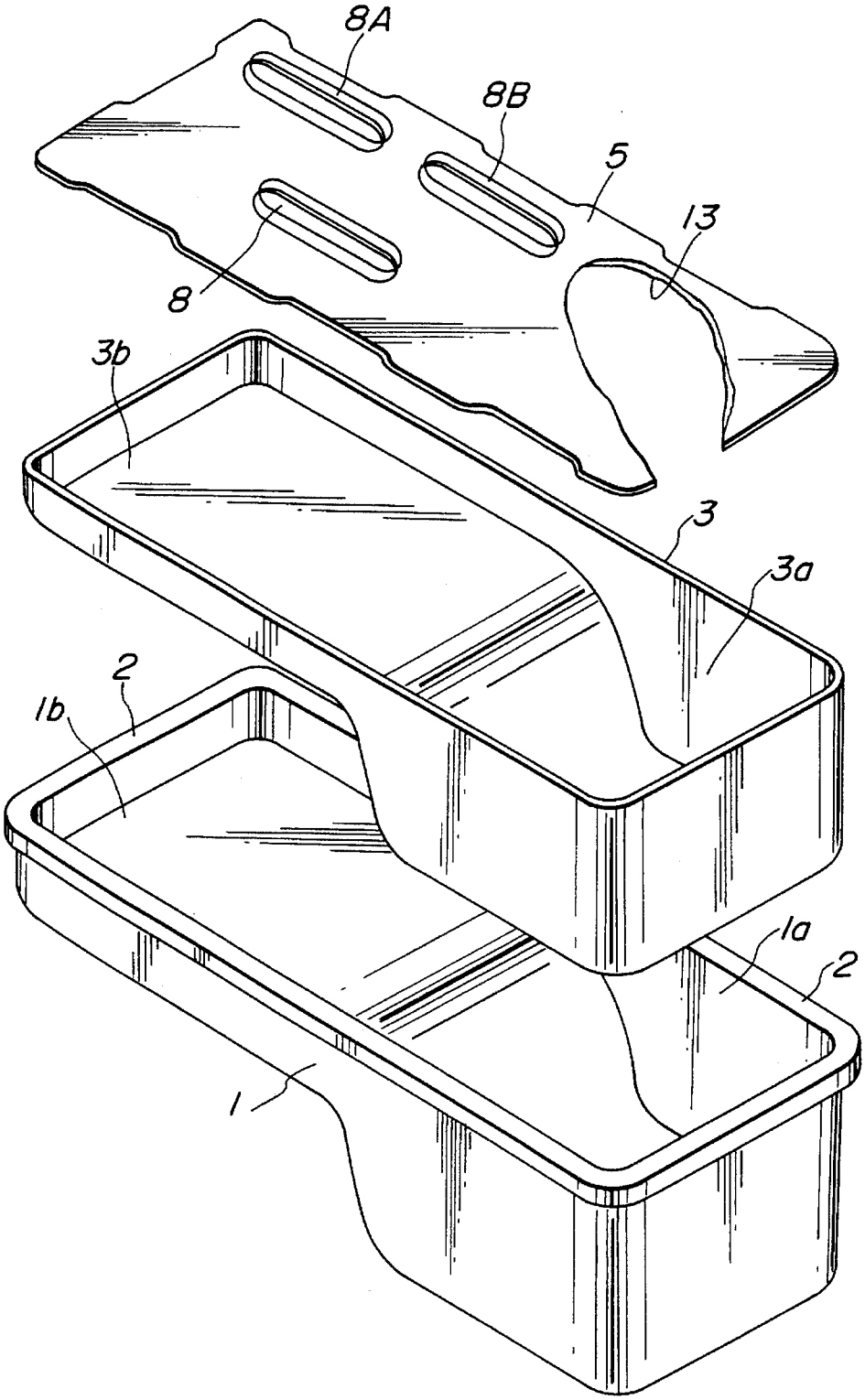
FIG. 3 is an exploded perspective view of the oil pan of the first embodiment.

Referring now to the drawings, particularly to FIGS. 1–3, a first preferred embodiment of an oil pan 1 according to the invention will be described hereinbelow in detail.

As may be seen in FIG. 1, the oil pan 1 comprises a deep portion 1*a* and a shallow portion 1*b* respectively having flat bottoms. At an upper peripheral portion of the oil pan 1, a flange 2 is formed at which the oil pan 1 is attached to the lower side of an engine cylinder block (not shown).

Inside the oil pan 1, an inner pan 3 formed of pressed steel plate is accommodated. Like the oil pan 1, the inner pan 3 is comprised of a deep portion 3*a* and a shallow portion 3*b* such that the shape of the inner pan 3 follows the contours of the inner surface of the oil pan 1. As seen in FIGS. 1 and 2 the inner pan 3 sits in the oil pan 1 such that a space 4 is provided between the inner pan 3 and the oil pan 1. Referring to FIG. 2, the space 4 extends to both bottom and side portions of the oil pan 1 and the inner pan 3. When oil accumulates in the oil pan 1, some oil will be held in the inner pan 3 while some of the oil flows freely in the space 4. It will be noted that the positioning of the inner pan 8 relative the oil pan 1 is not fixedly established.

It will further be noted that a bottom contour of said oil pan may include convex portions for defining said space 4 between said oil pan 1 and said inner pan 3.

Referring to FIGS. 1—3 a baffle plate 5 is fixed at an upper side of the oil pan 1, in a position over the inner pan 3, so as to prevent splashing of oil accumulated in the oil pan 1. The baffle plate also serves to limit movement of the inner pan 8. The baffle plate is formed with a plurality of elongate openings 8 to allow oil to flow downward from the engine interior to the oil pan 1. According to the present embodiment, the baffle plate includes openings 8A and 8B which are parallel to and proximate edge portions of the baffle plate 5 such that, when oil runs down from engine interior components, such as a conrod 6 or crankshaft 7 (FIG. 1), oil is introduced into the space 4 between the inner pan 3 and the oil pan 1.

As best seen in FIG. 2, a drain cock 9 is provided on a front side portion of the deep portion 1*a* of the oil pan 1. Corresponding to the positioning of the drain cock 9, a drain opening 10 is provided in the inner pan 3 to allow oil to be drained completely from both the inner pan 3 and the oil pan 1. A suction pipe 12 having a strainer 11 attached to an end thereof extends downwardly into the deep portion 3*a* of the inner pan 3. The suction pipe 12 is associated with an oil pump (not shown) of the engine (not shown) for supplying lubricating oil from the oil pan 1 to the engine components. The suction pipe introduced to the inner pan 3 through a cut-out 13 provided in the baffle plate 5.

Figure 4:
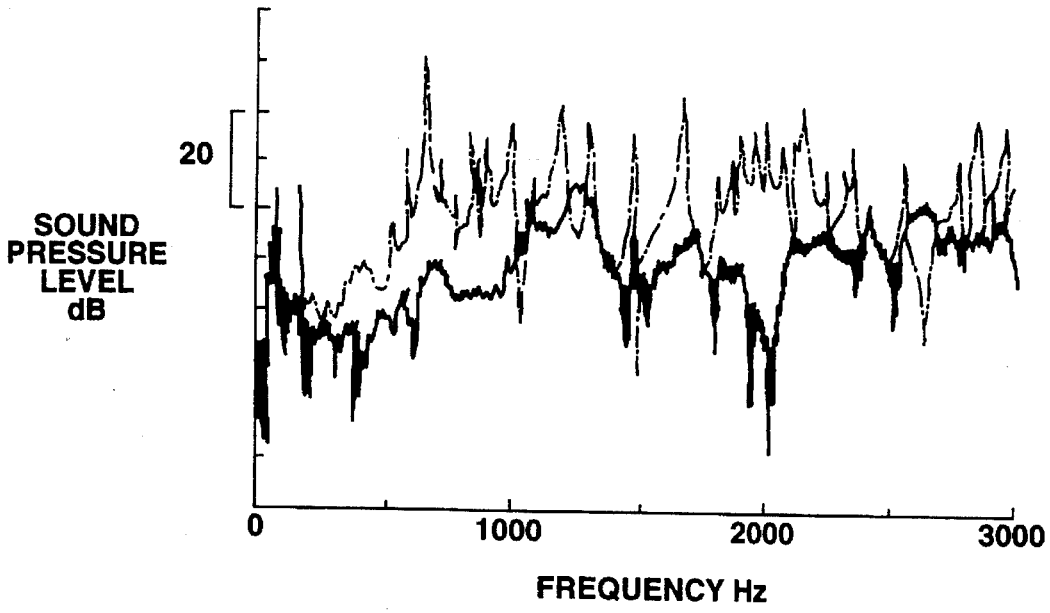
FIG. 4 is a graph comparing noise emmission levels of the oil pan of the invention and of a conventional oil pan.

When vibration is applied to the oil structure from the engine block (not shown), the dimension of the space 4 between the oil pan 1 and the inner pan 3 varies slightly causing oil in the space to move. Thus, vibrational energy transmitted to the oil pan 1 is absorbed by the motion of oil in the space 4. According to this, a wide range of vibration transmission to the oil pan 1 can be controlled. Further to this, owing to the inertia of the inner pan 3 disposed in the oil pan 1, when oil pressure is high, even greater energy reduction may be obtained. Referring to FIG. 4 it may be seen that, in noise level tests for the present invention as compared with a conventional oil pan, the noise level of resonant vibrations resulting from vibration applied to the oil pan 1 of the invention is significantly lower than that of the conventional oil pan over a substantially wide frequency range. Further, due to the viscosity of oil contained in the space 4, even if a very large vibration is applied to the oil pan structure, the inner pan 3 cannot be displaced in a manner so as to strike the oil pan 1 or the baffle plate 5 with damaging force.

Further, according to the above described construction, since the inner pan 3 need not be fixed in position relative the oil pan 1, manufacturing is simplified and assembly steps such as welding or the like, are not necessary and costs may be reduced. In addition, control of the volume of oil in the space 4 is extremely simple and the inertia of the inner pan 3 serves to keep the thickness of the space 4 to a minimum. Thus, be determining a weight of the inner pan 3 to be high, vibration suppression characteristics also become high.

Also, since the opening 10 of the inner pan 3 is provided in a location corresponding to the drain cock 9 of the oil pan 1, draining of oil from the engine for performing oil changes or maintenance may be accomplished smoothly.

Figure 5:
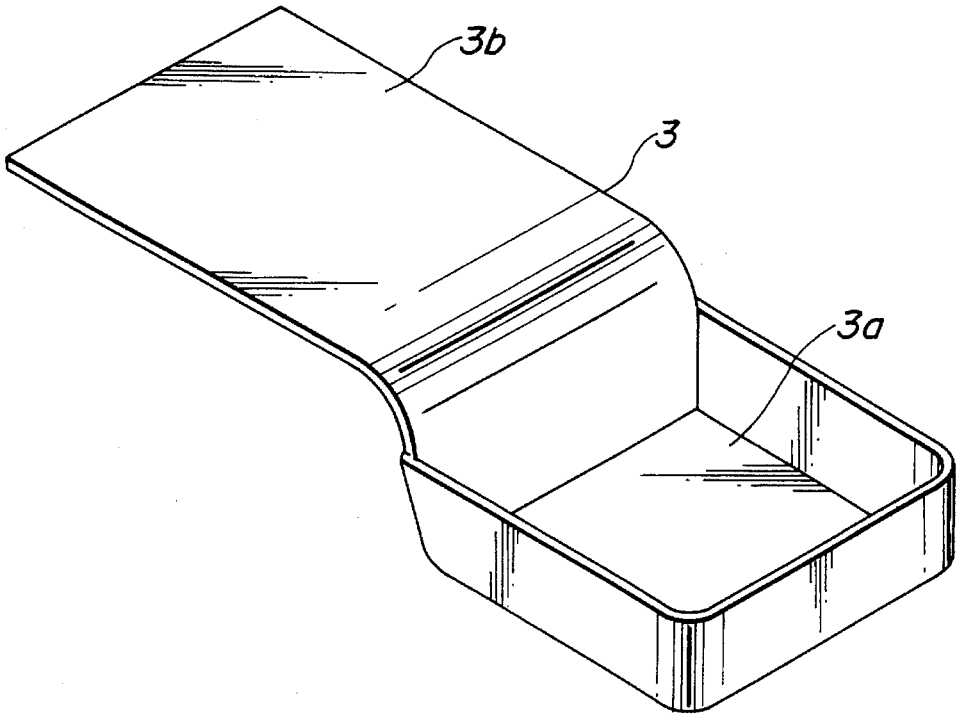
FIG. 5 is a perpsective view of a major portion of an oil pan according to a second preferred embodiment of the invention.

Referring now to FIG. 5, a second preferred embodiment of an inner pan structure according to the invention will be described hereinbelow in detail.

As may be seen in the drawing, the inner pan 3 of the second embodiment includes a deep portion 3*a* and a shallow portion 3*b*, similar to the previous embodiment. However, according to the present embodiment, the side walls of the deep portion 3*a* are relatively lower than the side walls of the oil pan 1 and the shallow portion 3*b* has no side walls. According to this construction, costs are reduced and assembly further simplified while all the same advantages taught in the previous embodiment may be obtained.

Figure 6:
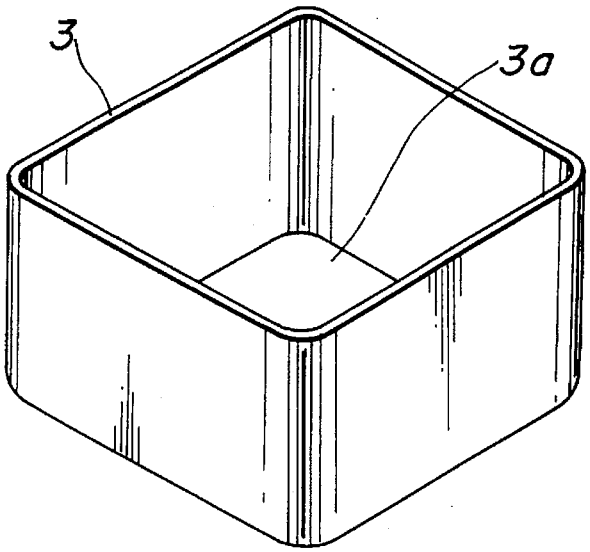
FIG. 6 is a perspective view of an oil pan according to a third embodiment of the invention.

FIG. 6 shows a third embodiment of the invention. The inner pan 3 of the third embodiment is in a cup shape consisting of a deep portion 3*a* defined by four side walls and a bottom wall. According to this, the inner pan 3 is provided in the deep portion 1*a* of the oil pan 1. According to this, the same advantages as the previous embodiments are available and cost and weight may be further reduced.

Figure 7:
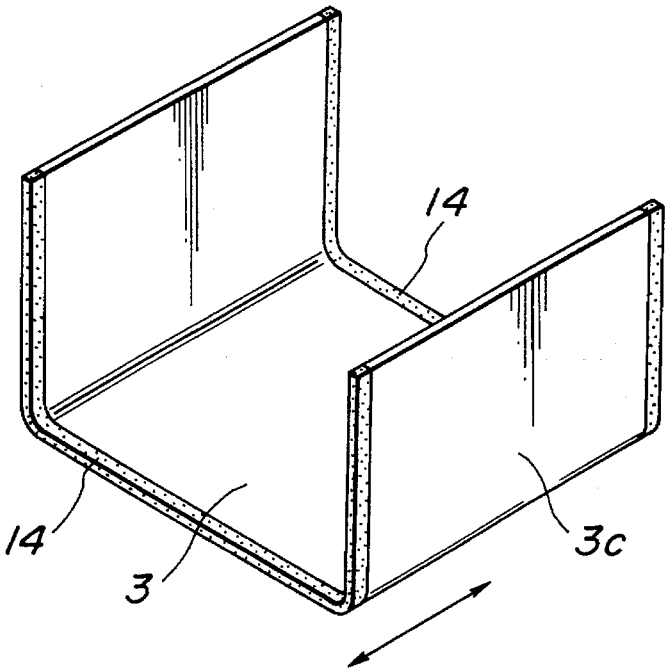
FIG. 7 is a perspective view of an oil pan according to a fourth embodiment of the invention.

Referring now to FIG. 7, a fourth embodiment of an inner pan 3 according to the invention is shown. According to this embodiment, the inner pan 3 comprises a U-shaped plate such that the bottom of the inner pan 3 is defined between front and rear walls 3*c*, 3*c* while no side walls are provided. The inner pan 3 may be formed of a metal plate via bending processing or the like. According to this construction, noise suppression is obtained and filling and draining of oil to and from the oil pan 1 is optimally facilitated. Also the simple structure reduces manufacturing costs and reduces radiant heat of oil in the inner pan 3. Resilient members 14, 14 are provided at both sides of the inner pan 3 such that when the inner pan 3 is subjected to side to side (arrow direction if FIG. 7) movement, noise is not produced by contact between the sides of the inner pan 3 and the inner walls of the oil pan 1.

Figure 8:
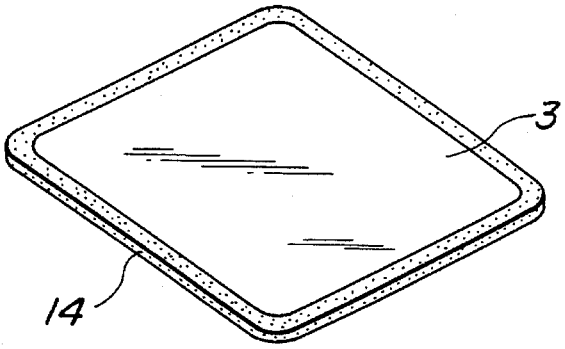
FIG. 8 is a perspective view of an oil pan according to a fifth embodiment of the invention.

In FIG. 8, a fifth embodiment of the inner pan 3 of the invention is shown. According to this embodiment, the inner pan 3 consists only of a rectangular plate disposed in the bottom of the deep portion 1*a* of the oil pan 1. The resilient member 14 is provided completely around the peripheral edge of the inner pan 3 to prevent noise resulting from contact between the inner pan 3 and the oil pan 1.

Figure 9:
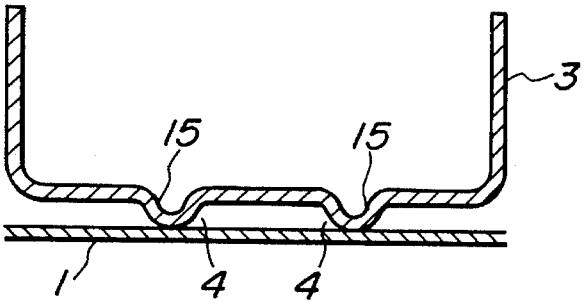
FIG. 9 is a cross-sectional lateral view of a bead portion of an inner pan according to a sixth preferred embodiment.

According to the above described embodiments, the lower side of the inner pan 3 is of a flat construction. Referring to the sixth embodiment shown in FIG. 9, it may be seen that, alternatively, projecting portions, or beads 15 may be formed on the lower side of the inner pan 3 for maintaining a certain minimum width of the space 4 for allowing oil to flow therein even when oil levels are low, or to further facilitate draining of oil from the oil pan 1.

Figure 10:
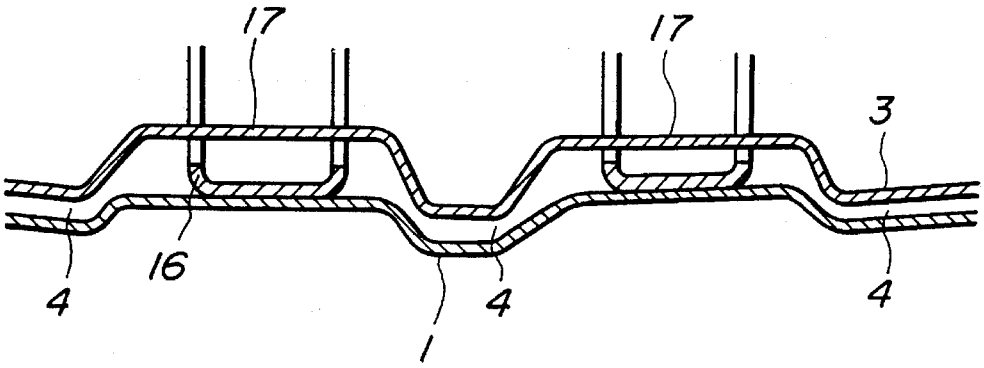
FIG. 10 shows a reinforced portion of an oil pan according to a seventh embodiment of the invention.

FIG. 10 shows a seventh embodiment according to the invention. According to this, reinforcing members 16 are provided between the oil pan 1 and the inner pan 3 and thus a relatively wide bead 17 is formed for accomodating the reinforcing portions. The space between the inner pan 3 and the oil pan 1 not occupied by the reinforcing members 16 or the bead 17 thus act as the space 4 for allowing oil to flow between the inner pan 3 and the oil pan 1, in other respects the present embodiment functions similarly to the above-described sixth embodiment.

Hereinbelow, with reference to FIGS. 11–14, additional embodiments of the invention, relating to the side wall structure of the inner pan 3 will be described in detail.

Figure 11:
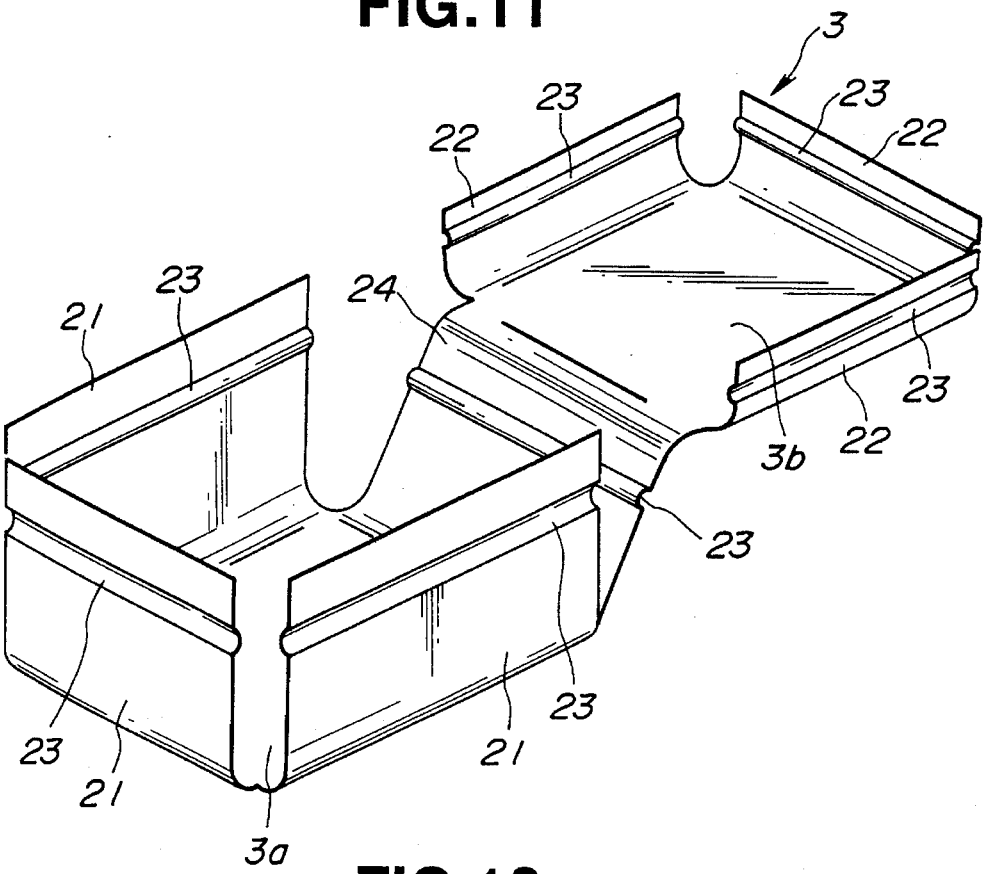
FIG. 11 is a perspective view of an inner pan according to an eighth embodiment of the invention.

Referring now to FIG. 11, an eighth embodiment of an inner pan 3 according to the invention is shown. According to this embodiment, the inner pan 3 includes a deep portion 8*a*, and a shallow portion 3*b* similar to the first embodiment. Side walls 21, 21, 21 are provided for the deep portion 3*a* and side walls 22, 22, 22 are provided for the shallow portion 3*b*. Since no corner portions are formed between the side walls 21, 21 or 22, 22, the inner pan 3 may be pressed from a flat piece of metal plate and manufacturing is simplified. An additional feature of the present embodiment is a bead 23 that is formed around a circumferential section of each of the side walls 21, 21 . . . 22, 22 . . . In addition, a bead 23 is formed laterally along a section 24 of the bottom of the inner pan 3 which connects the deep portion 3*a* with the shallow portion 3*b*. According to provision of the bead 23, and the lack of corner portions, in an instance, for example, when the oil pan 1 collides with a curbstone or other obstacle, when the inner pan 3 is knocked up against the lower side of the baffle plate, the relatively fragile bead 23 will allow the associated wall section (21, 22, 24) to deform such that strong impact is not transmitted to the baffle plate 5. In addition, according to this construction, under no circumstances will the baffle plate or the inner pan interfere with operation of the con rods 6 or other engine components.

Figure 12:
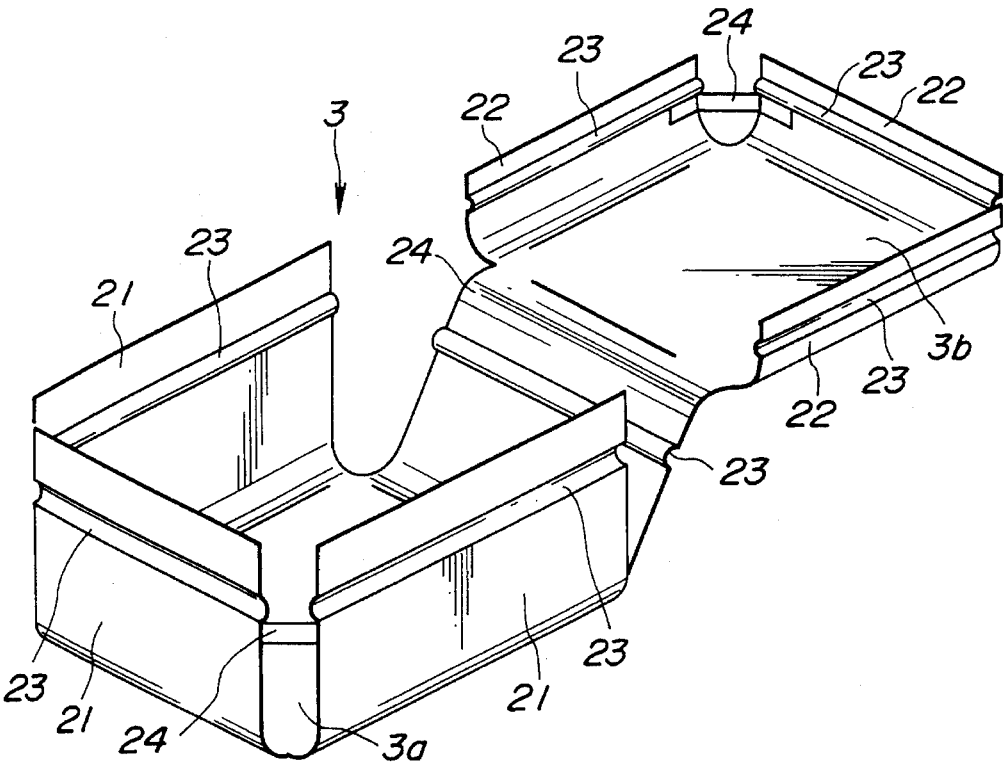
FIG. 12 is a perspective view of an inner pan according to an ninth embodiment of the invention.

FIG. 12 shows a ninth embodiment of the invention, according to this embodiment, the inner pan 3 is of the same construction as in the above-described eighth embodiment with the additional feature of corner portions 24 being attached by welding at the four extreme corners of the inner pan 3. According to this, additional rigidity and weight is obtained, though the wall portions remain deformable in case of impact.

Figure 13:
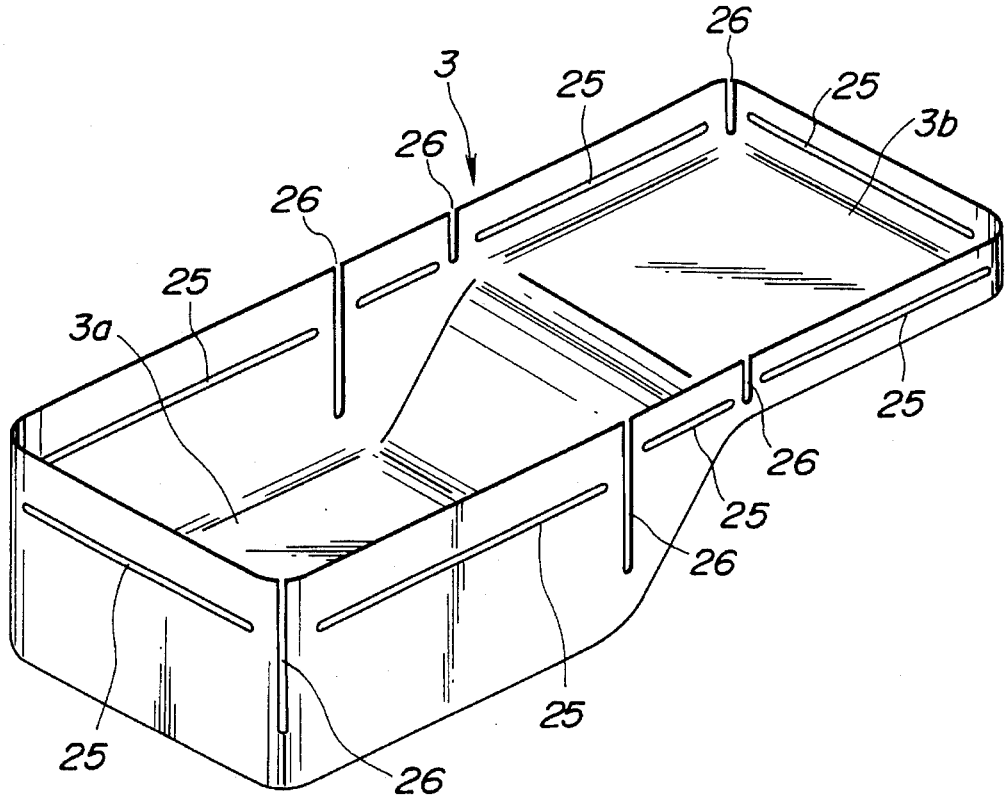
FIG. 13 is a perspective view of an inner pan according to an tenth embodiment of the invention.

Referring now to FIG. 13, an inner pan 3 according to the tenth embodiment of the invention is shown. The inner pan 3 of the present embodiment is similar in structure to that of the first embodiment shown in FIG. 3. However, according to the present embodiment, at corner portions of the inner pan 3 as well as at the boundaries of the deep portion 3*a* and the shallow portion 3*b*, vertical slits 26 are formed. In addition, horizontal slits 25 are formed at an upper side of each side wall portion between, but not meeting, the vertical slits 26. According to this construction, similar advantages as those described in connection with the eighth and ninth embodiments may be obtained.

Figure 14:
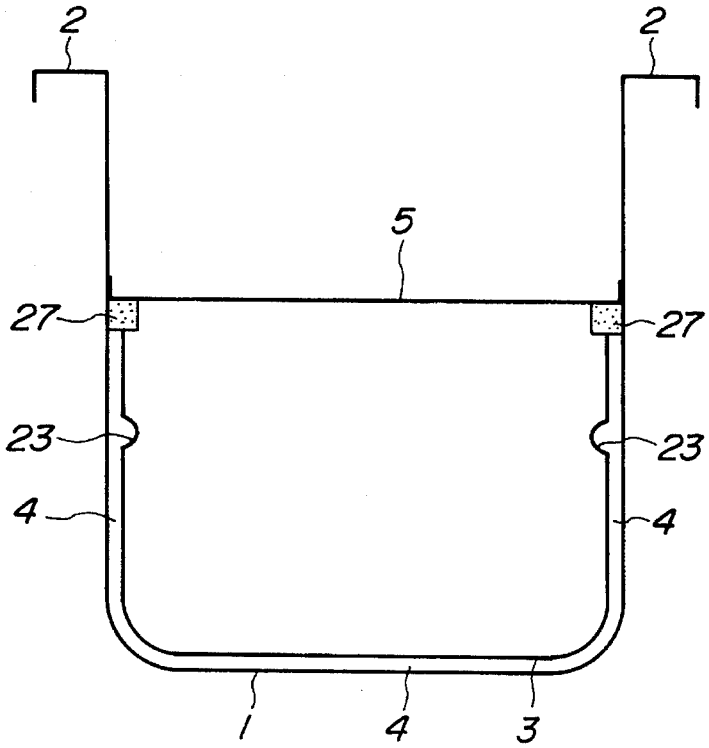
FIG. 14 is a lateral cross-sectional view showing the disposition of resilient members between the baffle plate and the inner pan according to an eleventh embodiment of the invention.

Finally, referring to FIG. 14, an eleventh embodiment of an inner pan according to the invention is shown. According to this embodiment, a resilient member 27 is provided at an upper peripheral edge of the inner pan 3 such that the resilient member 27 is interposed between the baffle plate 5 and the inner pan 3. In the figure, an inner pan 3 including the circumferential bead 23 is shown, though the present stucture may be implemented with any of the above-described embodiments. According to this, noise resulting from contact between the upper side of the inner pan 3 and the lower side of the baffle plate 5 is prevented and.

Thus, according to the invention, noise emission caused by engine vibrations applied to an engine oil pan may be significantly reduced at low cost and with simple structure. These advantages may be reliably obtained according to any of the embodiments described herein.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. An oil pan structure for an internal combustion engine, comprising:

an outer pan attachable at an open upper side thereof to a lower portion of a cylinder block of said internal combustion engine; and an inner pan disposed within said outer pan so as to float freely in a fluid contained in said outer pan, wherein a space is defined between an inner side of said outer pan and an outer side of said inner pan, said fluid occupying said space.

2. An oil pan structure for an internal combustion engine, comprising:

an outer pan attachable at an open upper side thereof to a lower portion of a cylinder block of said internal combustion engine; and an inner pan disposed within said outer pan so as to float freely in a fluid contained in said outer pan, wherein a space is defined between an inner side of said outer pan and an outer side of said inner pan, said fluid occupying said space; and a baffle plate attached at an upper side of inner walls of said outer pan so as to cover said open upper side of said outer pan, said baffle plate limiting a vertical movement of said inner pan.

3. An oil pan structure as set forth in claim 2, wherein said baffle plate includes a plurality of elongate openings therethrough.

4. An oil pan structure as set forth in claim 3, wherein said elongate openings are provided proximate a peripheral edge of said baffle plate.

5. An oil pan structure as set forth in claim 2, wherein said baffle plate includes a cut-out portion for admitting an oil suction pipe of said engine.

6. An oil pan structure as set forth in claim 2, further including a resilient member provided around a lower peripheral edge of said baffle plate such that said resilient member is interposed between said upper edge of said inner pan and a lower side of said baffle plate.

7. An oil pan structure as set forth in claim 2, further including a resilient member provided around an upper peripheral edge of said inner pan such that said resilient member is interposed between said upper edge of said inner pan and a lower side of said baffle plate.

8. An oil pan structure as set forth in claim 2, further including a resilient member interposed between an upper edge of said inner pan and a lower side of said baffle plate.

9. An oil pan structure as set forth in claim 2, further including a drain cock provided through said outer pan, said inner pan including an opening therethrough at a location corresponding to the location of said drain cock.

10. An oil pan structure as set forth in claim 2, further including a resilient member provided along side edges of said inner pan.

11. An oil pan structure as set forth in claim 2, further including a resilient member provided along a peripheral edge of said inner pan.

12. An oil pan structure as set forth in claim 2, wherein said outer and inner pans respectively include a deep portion adjacent a shallow portion.

13. An oil pan structure as set forth in claim 2, wherein said inner pan includes wall portions surrounding at least said deep portion of said inner pan.

14. An oil pan structure as set forth in claim 2, wherein said inner pan includes wall portions surrounding said deep and shallow portions.

15. An oil pan structure as set forth in claim 14, wherein said wall portions are formed with a bead in an upper portion thereof parallel to an upper edge of said wall portions such that said wall portions are made to be resiliently deformable in the vertical dimension.

16. An oil pan structure as set forth in claim 14, wherein said wall portions are formed with a slit in an upper portion thereof parallel to an upper edge of said wall portions such that said wall portions are made to be resiliently deformable in the vertical dimension.

17. An oil pan structure as set forth in claim 14, wherein corner areas defined by a meeting of two of said wall portions include a vertical slit at a location corresponding to said corner area.

18. An oil pan structure as set forth in claim 2, wherein said inner pan comprises a rectangular plate having a resilient member provided at peripheral edges thereof.

* * * * *